US005290185A

United States Patent [19]

Murakami

[11] Patent Number: 5,290,185

[45] Date of Patent: Mar. 1, 1994

[54] HOOK THROWING BOXING REMOTE CONTROL TOY ROBOT

[75] Inventor: Seiji Murakami, Tokyo, Japan

[73] Assignee: Kabushiki Kaisha Bandai, Japan

[21] Appl. No.: 998,794

[22] Filed: Dec. 30, 1992

[30] Foreign Application Priority Data

Sep. 3, 1992 [JP] Japan ..... 4-068048[U]

[51] Int. Cl.[5] ..... A63H 13/06; A63H 13/36; A63H 3/20

[52] U.S. Cl. ..... 446/334; 446/390; 446/330

[58] Field of Search ..... 446/334, 335, 336, 330, 446/352, 353, 354, 380, 390, 454

[56] References Cited

U.S. PATENT DOCUMENTS

| | | | |
|---|---|---|---|
| 3,235,259 | 2/1966 | Glass et al. | 446/334 X |
| 3,648,405 | 3/1972 | Tepper | 446/330 |
| 4,279,099 | 7/1981 | Dyer et al. | 446/330 |
| 4,605,382 | 8/1986 | Cook et al. | 446/334 X |
| 4,608,026 | 8/1986 | Newton et al. | 446/334 X |
| 4,623,318 | 11/1986 | Tsiknopoulos et al. | 446/334 X |
| 4,828,530 | 5/1989 | Lee | 446/330 X |
| 4,995,610 | 2/1991 | Paoletti | 446/335 X |

FOREIGN PATENT DOCUMENTS

| | | | |
|---|---|---|---|
| 837672 | 5/1952 | Fed. Rep. of Germany | 446/334 |
| 2040708 | 9/1980 | United Kingdom | 446/335 |

*Primary Examiner*—David N. Muir
*Attorney, Agent, or Firm*—R. Gale Rhodes, Jr.

[57] ABSTRACT

A toy robot which can make realistic movement of boxing. The robot has plural driver devices each having an electric motor. The robot has arms driven by the driver devices. The driver devices are remotely controlled to operate the arms. The robot has a waist and a pillar protruding upward from this waist. One of the driver devices rotates the trunk through a given angle against the action of a return spring. One arm is held to a pivot mounted at one shoulder portion such that the arm can rotate laterally. An operating member is mounted to the pivot. As the trunk turns, the operating member pushes the underside of the bearing portion of the arm. The other arm can be bent at its elbow and consists of an upper arm and a forearm which are joined together by a link. When the upper arm is directed forward, the upper arm and the forearm are made substantially straight. Another driver device rotates the upper arm forwardly from below.

3 Claims, 4 Drawing Sheets

HOOK THROWING BOXING REMOTE CONTROL TOY ROBOT

FIELD OF THE INVENTION

The present invention relates to a toy robot which plays a game of boxing and also to a toy robot having driver devices at various portions.

BACKGROUND OF THE INVENTION

The prior art toy robot playing a game of boxing has both arms shaped like bellows. The bellows are stretched and contracted to play a game of boxing. The prior art toy robot is further equipped with a driver device including an electric motor inside the trunk. Lead wires extend from the trunk through control means for the driver device to the motor. Also, lead wires extend from the trunk through the articulations of the arms and of the legs via the control means that provides control of the driver device.

Accordingly, the prior art toy robot playing a game of boxing lacks reality. For example, it has been impossible for the robot to rotate its trunk and swing the arms, i.e., the robot is unable to hook. Also, it has been impossible for the robot to bend and stretch the arms, utilizing driver devices, i.e., the robot is unable to deliver a so-called straight punch. Furthermore, in the prior art toy robot, the lead wires extend from the motors in the trunk through the articulations of the arms and of the legs and so it is impossible to assemble individual parts separately. Hence, it has been cumbersome to assemble the toy.

SUMMARY OF THE INVENTION

In view of the foregoing drawbacks, the present invention has been made.

It is an object of the present invention to provide a toy robot which can make realistic boxing movement.

It is another object of the invention to provide a toy robot which permits individual parts such as legs to be assembled separately, thereby greatly reducing the number of assembling steps.

One embodiment of the present invention lies in a toy robot comprising: a body having a waist and a trunk rotatably mounted to a pillar protruding upwardly from the waist that has a leg portion, the trunk being connected with the pillar via a resilient member, the pillar having a stationary portion; a driver device mounted in the trunk for rotating the trunk through a given angle against the action of the resilient member; a pivot mounted at at least one shoulder portion of the trunk; an arm mounted to one end of the pivot so as to be rotatable laterally; and an operating member movably mounted to the pivot, one end of the operating member being connected with the stationary portion of the pillar. When the trunk is rotated, the other end of the operating member moves and pushes one side of the arm laterally.

Another embodiment of the invention lies in a toy robot comprising: a body having a trunk and one arm rotatably held to at least one shoulder portion of the trunk, the arm being divided into an upper arm and a forearm and capable of being bent at its elbow, the forearm and the shoulder portion being connected together by a link in such a way that when the upper arm is directed downward, the forearm is bent relative to the upper arm and that when the upper arm is directed forward, the upper arm and the forearm are made substantially straight; and a driver device mounted in the trunk for rotating the upper arm forwardly from below.

A further embodiment of the invention lies in a toy robot comprising: a body having a trunk, an arm mounted at one shoulder portion of the trunk that has a waist, and a leg portion mounted to the waist; the trunk being equipped with a driver device having an electric motor; either the arm or the leg portion or both being equipped with driver devices having electric motors; a printed-wiring board mounted at one side of either the trunk or the waist and having a plurality of connectors; and plugs connected with the connectors, respectively, and attached to lead wires extending from the motors of the driver devices.

In the structures described above, the trunk is mounted in such a way that it can rotate about the pillar. The trunk is biased in a given direction by the resilient member. When the operating member is operated, the trunk can be rotated against the action of the resilient member. When the trunk is rotated through a given angle by the driver device, it is free to move. Under this condition, the trunk is momentarily returned to its original condition by the restoring force of the resilient member. As the trunk turns, the working end of the operating member whose one end is connected with the pillar is shoved along the pivot that protrudes from the shoulder portion of the trunk. The lower side of the bearing portion of the arm held to the pivot is pushed by this working end. This rotates the arm such that the arm is shoved laterally. In this way, one side of the arm is pushed up in step with rotation of the trunk. Consequently, operations resembling boxing hook can be performed.

The other arm is held to the corresponding shoulder portion of the trunk in such a way that the arm can rotate forwardly. The driver device connected with the shoulder portion rotates the arm forwardly through a given angle. The arm can be momentarily returned to its original position. The arm can be bent at its elbow. The upper arm is connected with the bearing portion of the arm by a link mechanism. When the upper arm is directed downward, the forearm is bent relative to the upper arm. When the arm rotates forwardly, the upper arm and the forearm are made substantially straight, and the forearm is shoved substantially horizontally. Hence, operations resembling a straight punch of boxing can be performed.

In the structures described above, the plural driver devices including the motors are mounted in the trunk of the body. Also, the leg portion can be equipped with the driver devices to permit the leg portion to run. The lead wires are connected with the motors of these driver devices. The plugs are connected with ends of the lead wires; these ends are not directly connected with connectors for external connection. The printed-wiring board having the connector for connection with the external controller and the other connectors is mounted at one side of the trunk or of the waist of the body. The plugs attached to the lead wires extending from the motors can be connected with their respective connectors. In this way, the lead wires to the motors in the body are not inseparable but can be separated via the plugs. Consequently, the body and the leg portion can be assembled as separate parts. This can greatly reduce the number of assembling steps.

Other objects and features of the invention will appear in the course of the description thereof which follows.

DETAILED DESCRIPTION OF THE INVENTION

Figure 1:
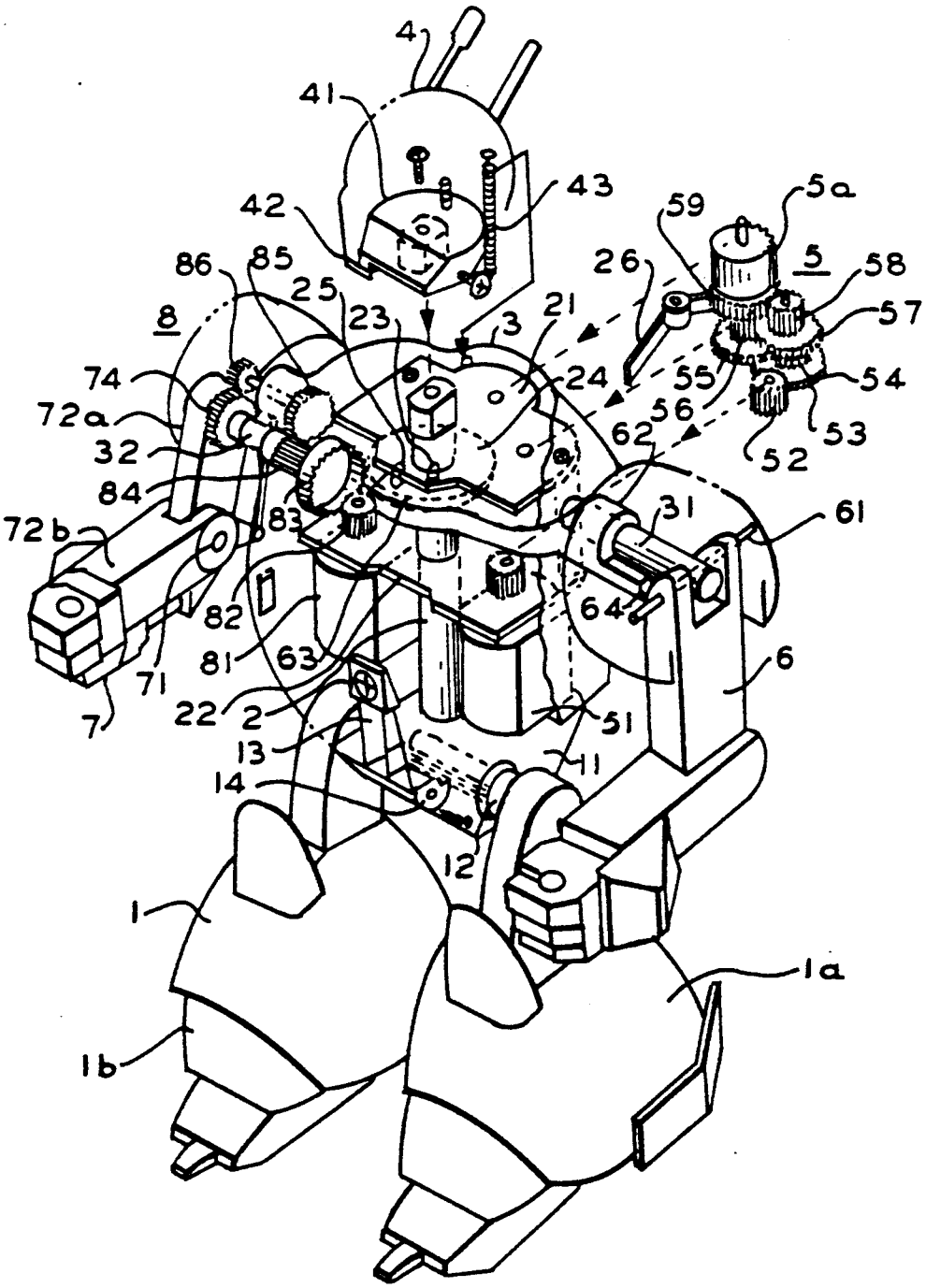
FIG. 1 is a partially cutaway, exploded perspective view of a toy robot according to the present invention.

Referring to FIGS. 1–6, there is shown a toy robot embodying the concept of the present invention. Referring first to FIG. 1, this robot has a leg portion 1 including a waist 11. A pillar 2 protrudes upwardly from the waist 11. Bearing plates 21 and 22 are rotatably mounted to the pillar 2. A trunk 3 divided into a front part and a rear part is mounted in such a way that the bearing plates 21 and 22 are held between these front and rear parts of the trunk. The trunk 3 can rotate about the pillar 2 via the bearing plates 21 and 22.

The robot further includes a head 4 having a mounting seat 41 which is mounted at the upper end of the pillar 2. The bearing plate 21 that is located opposite to the mounting seat 41 has a protruding stopper 23 shaped like a rib. The bottom surface of the mounting seat 41 has an engaging fringe 42 which is made to abut against the side surface of the stopper 23.

The range of movement of the bearing plate 21 is limited by the engaging fringe 42 that is opposite to the stopper 23. The range of rotation of the trunk 3 which is integral with this bearing plate 21 is also limited. A return spring 43 is screwed to one side of the mounting seat 41. One end of this spring 43 is fixed to one end of the bearing plate 21. Thus, the trunk 3 is always urged to return to the engaging fringe 42 in a clockwise direction as viewed from above.

A stationary gear 24 is mounted to the pillar 2. A reduction gearing consisting of a gear 53, a pinion 54 integral with the gear 53, a gear 55 in mesh with the pinion 54, a pinion 56 integral with the gear 55, a gear 57 in mesh with the pinion 56, a pinion 58 integral with the gear 57, and a gear 59 in mesh with the pinion 58 is mounted between the bearing plates 21 and 22. An electric motor 51 mounted to the bearing plate 22 has a pinion 52 with which the gear 53 is in mesh. A partially toothed wheel **5*a* is formed on the top of the gear 59 and in mesh with the stationary gear 24. In this way, a driver device 5 including the motor 51** and the reduction gearing is constituted.

A retaining member 26 in the form of a leaf spring is pivoted to the bearing plate 22. This retaining member 26 has an engaging end that bears against the gear 59 of the driver device 5. The other end of the retaining member 26 is so supported that it does not move along the inner wall of the trunk 3.

In the trunk 3, a pivot 31 extends horizontally from one shoulder portion. An arm 6 which is mounted to the pivot 31 via a shaft 61 can rotate laterally about one end of the pivot 31. An operating member 62 is movably mounted on the pivot 31. The operating member 62 has an engaging end portion 63 connected with an engaging protrusion 25 which protrudes over the stationary gear 24 on the pillar 2. The operating member 62 also has a working end 64 which pushes the underside of the bearing portion of the arm 6 when the trunk 3 is rotated.

The other shoulder portion of the trunk 3 has a bearing 32 by which a shaft protruding above the other arm 7 is held. The arm 7 consists of an upper arm **72*a* and a forearm 72*b* and can be bent at its elbow 71. The bearing 32 and the forearm 72*b* are provided with protruding plates 32*a* and 72*c*, respectively. These plates 32*a* and 72*c* are joined together by a link 73**.

A gear 74 is mounted at the upper end of the arm 7, or the shoulder portion. A reduction gearing comprising a crown gear 83, a pinion 84 integral with the crown gear 83, a spur gear 85 held to the shoulder portion, and a partially toothed wheel 86 formed on the rotating shaft of the spur gear 85 is mounted at the shoulder portion. An electric motor 81 mounted to the bearing plate 22 has a pinion 82 with which the crown gear 83 is in mesh. The spur gear 85 is in mesh with the pinion 84. The toothed wheel 86 is brought into mesh with the gear 74 to form a driver device 8 for the arm 7, the driver device 8 including the motor 81 and the reduction gearing.

Both legs **1*a* and 1*b* of the leg portion 1 are fixed to a rotating shaft 12 held to the waist 11. A substantially L-shaped target member 13 has a return spring and is held parallel to the rotating shaft 12. An engaging end portion 14 protrudes from the bottom of the target member 13 and is engaged in a groove formed in the rotating shaft 12 to prevent the waist 11 from rotating normally. The target member 13 has a target on its upper portion. When this target is hit, the engaging end portion 14 comes off, permitting the waist 11 to rotate. Then, the trunk 3 is thrown rearwardly together with the waist 11**.

Figure 6:
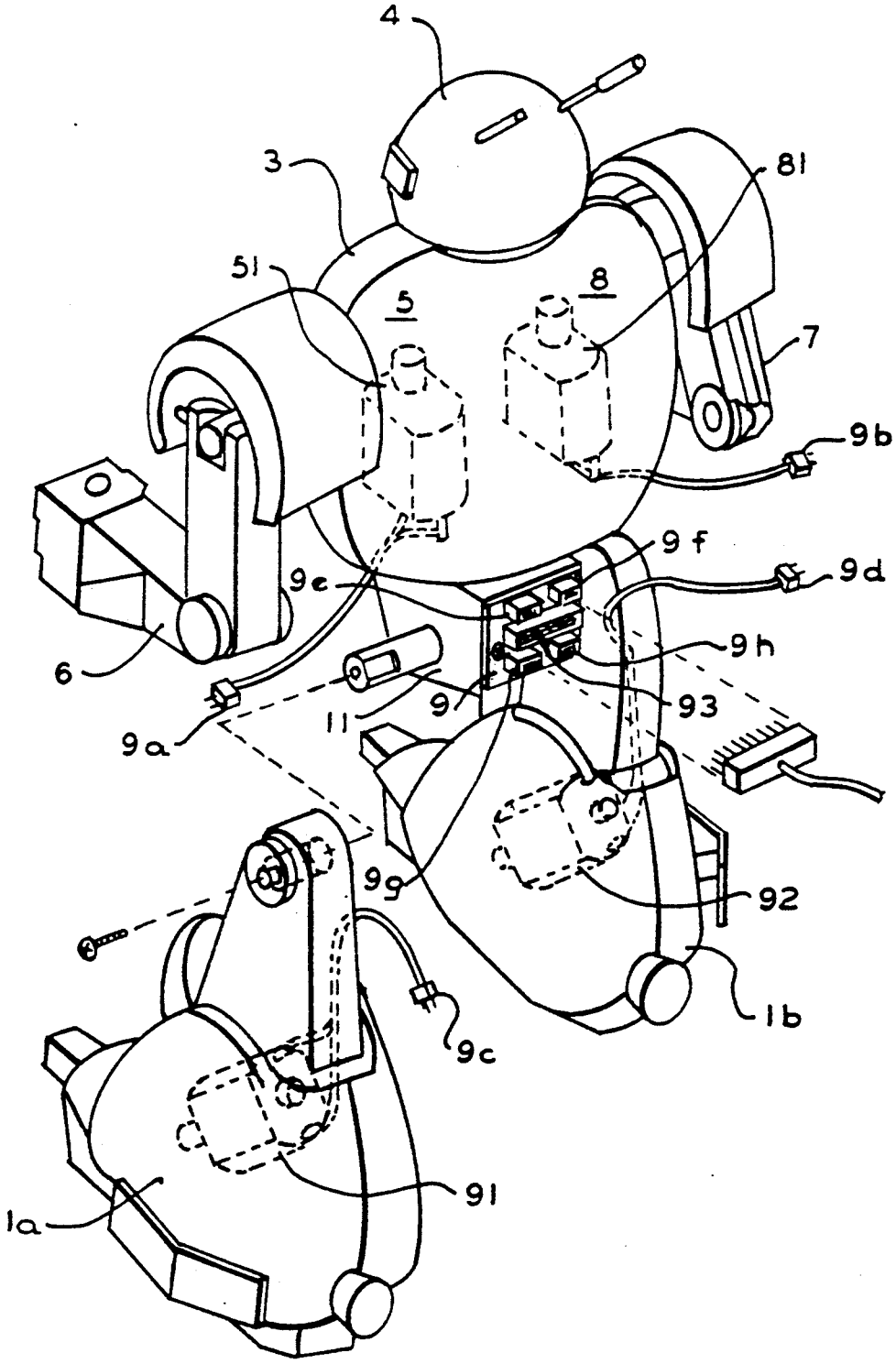
FIG. 6 is a partially cutaway, exploded perspective view of the toy robot shown in FIG. 1, as viewed from the rear side.

As shown in FIG. 6, the plural driver devices 5 and 8 including the motors 51 and 81, respectively, are mounted in the trunk 3 of the body. Each of the legs **1*a* and 1*b* of the leg portion 1 has front and rear wheels. Each wheel is provided with plural reduction gears to form a reduction gearing. A crown gear is mounted at the center of the reduction gearing. A plurality of driver devices are provided which include motors 91 and 92**, respectively, having pinions in mesh with the crown gears, respectively.

Lead wires are connected with the motors 51, 81, 91, 92 of these driver devices, and plugs **9*a*, 9*b*, 9*c*, 9*d* are connected with ends of these lead wires. A printed-wiring board 9 having a connector 93 for connection with an external controller and other connectors 9*e*, 9*f*, 9*g*, and 9*h* is mounted to the rear side of the waist 11 of the body. Lead wires are brought out from the printed-wiring board 9 and extend to the motors 51, 81, 91, and 92. The plugs 9*a*, 9*b*, 9*c*, and 9*d* at the ends are connected with their respective connectors 9*e*, 9*f*, 9*g*, and 9*h***.

Figure 2:
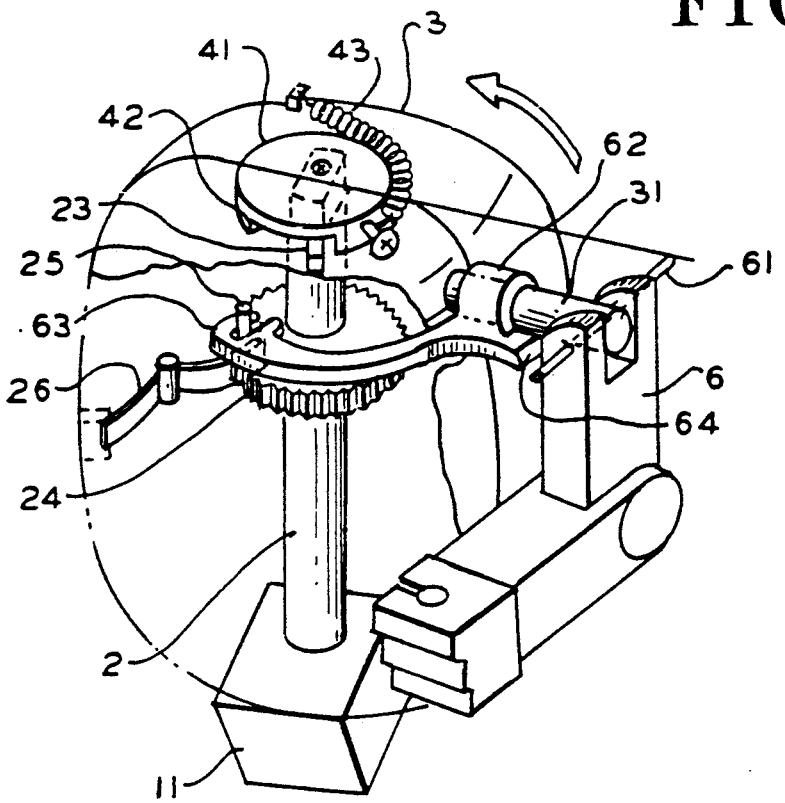
FIGS. 2 and 3 are partially cutaway perspective views of the left arm and the surrounding portions of the toy robot shown in FIG. 1, for showing different conditions.

In the structure described above, the trunk 3 is urged to rotate in a given direction, or in a clockwise direction, about the pillar 2 by the return spring 43. When a remote controller (not shown) is operated to activate the driver device 5, rotation of the motor 51 moves the position relative to the stationary gear 24 via the pinion 52, the gear 53, the pinion 54, the gear 55, the pinion 56, the gear 57, the pinion 58, the gear 59, and the partially toothed wheel **5*a*. As shown in FIG. 2, the trunk 3 can be rotated in a counterclockwise direction against the action of the return spring 43. When the trunk 3 rotates in this way, the operating member 62 is pulled to the left along the pivot 31, so that the arm 6 hangs parallel to the trunk 3**.

Figure 3:
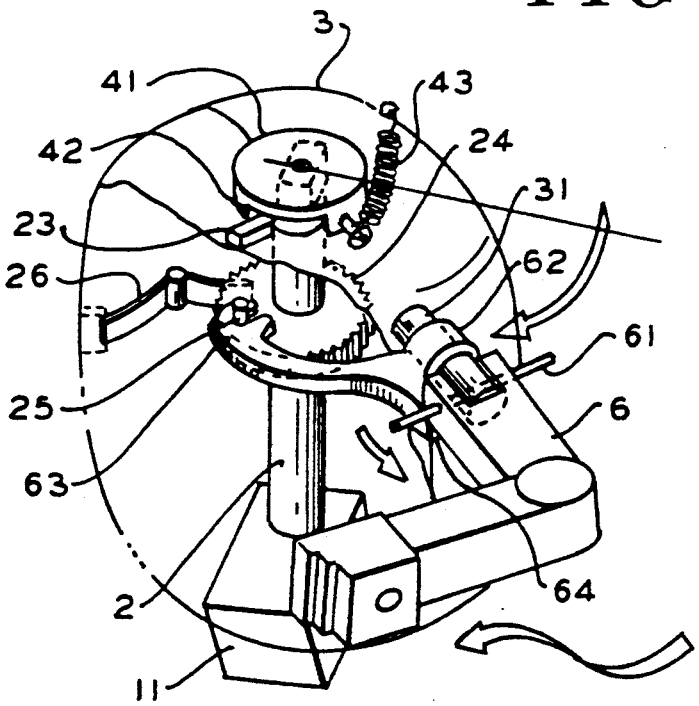

Rotation of the partially toothed wheel 5*a* of the driver device 5 rotates the trunk 3 through a given angle and then the trunk 3 is free to move. As shown in FIG. 3, the trunk 3 is rotated in a clockwise direction by the return spring 43. In this way, the trunk can be returned to the original condition momentarily. As the trunk 3 turns, the operating member 62 whose engaging end portion 63 is connected with the engaging protrusion 25 of the stationary gear 24 on the pillar 2 is pushed in such a way that the working end 64 is pushed to the right along the pivot 31 protruding from one shoulder portion of the trunk 3. This working end 64 is pressed against the underside of the bearing portion of the arm 6 held to the pivot 31. The arm 6 is rotated so as to be shoved laterally. In this way, as the trunk 3 rotates, the elbow of the arm 6 is lifted. As a result, operations resembling boxing hook can be performed.

Since the retaining member 26 pivoted to the bearing plate 22 abuts against the gear 59 of the driver device 5, no resistance is produced by making use of the resilience of the leaf spring of the retaining member 26 when the driver device 5 is operated. When the operation of the retaining member 26 is suspended, the returning movement of the gear 59 is stopped. The posture under this condition can be maintained. After the trunk 3 is biased counterclockwise and halted, if the driver device is restarted, the toy momentarily performs a series of operations resembling boxing hook. Consequently, the boxing movement is complicated and made more interesting.

Figure 4:
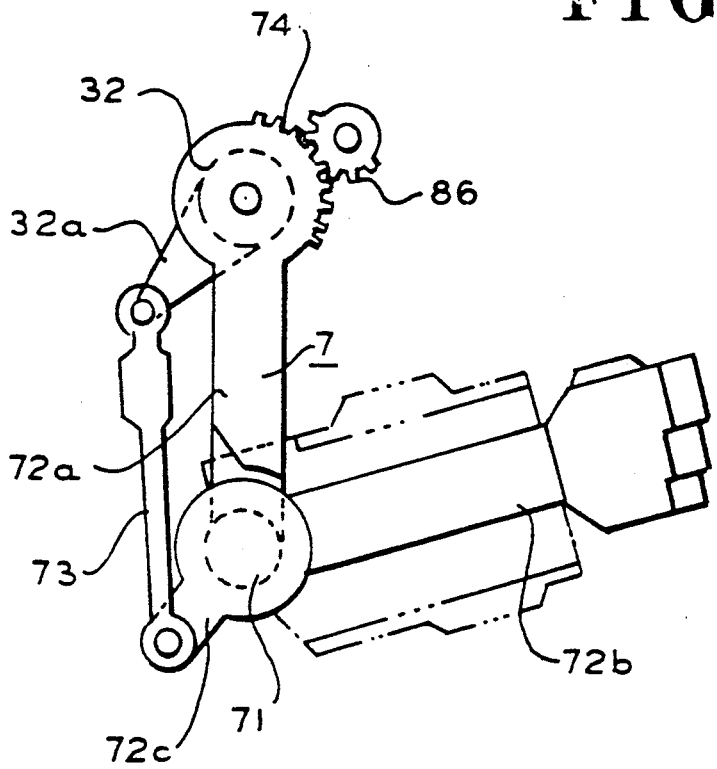
FIGS. 4 and 5 are partially cutaway side elevations of the right arm of the toy robot shown in FIG. 1.

In the trunk 3, the other arm 7 is forwardly rotatably held to its shoulder portion. This condition is shown in FIG. 4. When the remote controller (not shown) is operated to operate the driver device 8, rotation of the motor 81 rotates the gear 74 mounted to the shoulder portion of the arm 7 via the pinion 82, the crown gear 83, the pinion 84, the spur gear 85, and the partially toothed wheel 86.

Figure 5:
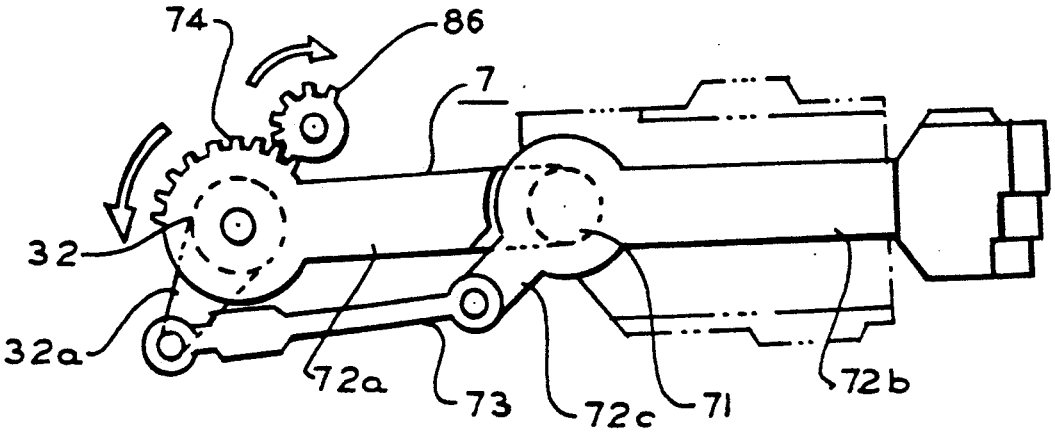

Rotation of the partially toothed wheel 86 of the driver device 8 rotates the arm 7 forwardly through a given angle, as shown in FIG. 5. Then, the toothless portion of the wheel 86 allows the arm 7 to momentarily return to its original position by its own weight. The arm 7 can bend at its elbow 71. The forearm 72*b* is joined to the bearing 32 of the arm 7 by the link 73. Therefore, when the arm 7 rotates forwardly, the forearm 72*b* is shoved while maintained in substantially horizontal posture. Hence, operations resembling a straight punch of boxing can be performed.

As described above, the driver device 5 is activated under remote control to lift the elbow of the arm 6 in step with rotation of the trunk 3. In this way, a series of operations resembling boxing hook can be performed. Also, the driver device 8 is operated to shove the forearm 72*b* forwardly of the arm 7 substantially horizontally in step with the rotation. In this way, a series of operations similar to a straight punch of boxing can be performed. The body can be moved at will by these operations and by forward and rearward movement of the leg portion 1. A game of boxing can be played by causing two toy robots of this structure to face each other and controlling them remotely. If a blow is struck at the target member 13 mounted on the waist 11 of the opponent toy robot, the engaging end portion 14 comes off, permitting the waist 11 to rotate. Then, the trunk 3 can be thrown rearwardly together with the waist 11.

The plugs 9*a*, 9*b*, 9*c*, and 9*d* are attached to the ends of the lead wires brought out from the motors 51, 81 in the trunk 3 and from the motors 91, 92 in the legs 1*a*, 1*b* of the leg portion 1. The printed-wiring board 9 having the connector 93 for connection with the controller and the other connectors 9*e*, 9*f*, 9*g*, and 9*h* is mounted to the rear side of the waist 11. The lead wires to the motors in the trunk 3 and in the leg portion 1 are not inseparable but can be separated via the plugs 9*a*, 9*b*, 9*c*, and 9*d*. Therefore, the trunk 3 and the leg portion 1 can be assembled as separate parts. Consequently, the number of assembling steps can be reduced greatly.

In the novel toy robot, when the trunk is rotated, the elbow of one arm is elevated. A series of operations similar to boxing hook can be performed. When the other arm is rotated forwardly, the forearm is shoved while held substantially in horizontal. In consequence, a series of operations similar to a straight punch of boxing can be performed. In this way, realistic boxing movement can be made. A game of boxing can be played by causing two toy robots of this structure to face each other and controlling them remotely. Furthermore, the individual parts can be made to make complex movement by remote control. Hence, a game involving sophisticated operations can be played.

The body of the novel toy robot is provided with the printed-wiring board on its one side. The board has a connector for connection with an external controller and the other connectors. No direct connection with an external connector is made. The plugs attached to the lead wires extending from the motors are connected with their respective connectors. In this way, the lead wires to the motors in the body are not inseparable but can be separated via the plugs. Consequently, the body and the legs can be assembled as separate parts. This can greatly reduce the number of assembling steps.

What is claimed is:

1. A toy robot, comprising:

a trunk mounted rotatably about a generally vertical shaft, said trunk provided with a shoulder portion;

a generally horizontal pivot mounted on said shoulder generally orthogonal to and displaced from said vertical shaft;

an arm mounted pivotally on said pivot and normally extending generally vertically downwardly; and electric means for rotating said trunk about said shaft and elevating means for elevating said arm about said pivot attached to said shaft to cause said arm to reside generally horizontally and to cause said arm to resemble a boxing hook being performed as said trunk is rotated.

2. A toy robot comprising:

a body having a waist, a shoulder portion and a trunk rotatably mounted to a pillar protruding generally vertically upwardly from the waist, the trunk being connected with the pillar via a resilient member, the pillar having a stationary portion;

a driver device mounted in the trunk for rotating the trunk about said pillar through a given angle against the action of the resilient member;

a pivot mounted generally horizontally on said one shoulder portion of the trunk, said pivot displaced generally horizontally from said pillar and oriented generally orthogonally with respect thereto;

an arm mounted on the pivot so as to be rotatable generally vertically about said pivot with respect to said body;

an operating member movably mounted to the pivot, one end of the operating member being connected with the stationary portion of the pillar;

and wherein when the trunk is rotated by said driver device, the other end of the operating member moves and pushes on one side of the arm and elevates the arm generally vertically with respect to said body to cause said arm to reside generally horizontally with respect to said body thereby to resemble a boxing hook being performed as said trunk rotates.

3. A toy robot comprising:

a body including a waist, a trunk mounted for rotation about a generally vertically oriented pillar, said body further including a shoulder portion and an arm;

a generally horizontal shaft mounted on said shoulder portion generally orthogonally with respect to and displaced generally horizontally from said pillar, said arm mounted pivotally on said shaft;

an operating member engageable with said arm to elevate said arm with respect to said body and to cause said arm to reside generally horizontally with respect to said body;

the trunk being equipped with a first driver device having an electric motor, said driver device operable to rotate said trunk about said pillar and to operate said operating member to elevate said arm and to cause said arm to resemble a boxing hook being performed as said trunk rotates;

either the arm or the leg portion or both being equipped with second driver devices having electric motors;

a printed-wiring board mounted at one side of the trunk or the waist and having a plurality of connectors; and plugs connected with the connectors, respectively, and attached to lead wires extending from the motors of the driver devices.

* * * * *